US010195474B2

(12) United States Patent
Hsu et al.

(10) Patent No.: US 10,195,474 B2
(45) Date of Patent: Feb. 5, 2019

(54) ELECTROMAGNETICALLY ACTUATED BICYCLE TRAINER AND RESISTANCE CONTROL METHOD THEREOF

(71) Applicant: GIANT MANUFACTURING CO., LTD., Taichung (TW)

(72) Inventors: Hsaio-Wen Hsu, Taichung (TW); Chih-Hsiang Shen, Taichung (TW)

(73) Assignee: GIANT MANUFACTURING CO., LTD., Taichung (TW)

( * ) Notice: Subject to any disclaimer, the term of this patent is extended or adjusted under 35 U.S.C. 154(b) by 426 days.

(21) Appl. No.: 15/204,499

(22) Filed: Jul. 7, 2016

(65) Prior Publication Data

US 2017/0128764 A1 May 11, 2017

(30) Foreign Application Priority Data

Nov. 6, 2015 (TW) ..... 104136636 A

(51) Int. Cl.
*A63B 21/00* (2006.01)
*A63B 21/005* (2006.01)
(Continued)

(52) U.S. Cl.
CPC ..... *A63B 21/0056* (2013.01); *A63B 21/0052* (2013.01); *A63B 21/0054* (2015.10); *A63B 21/00069* (2013.01); *A63B 21/225* (2013.01); *A63B 21/4034* (2015.10); *A63B 22/0605* (2013.01); *A63B 24/0087* (2013.01); *A63B 69/16* (2013.01); *A63B 2024/009* (2013.01); *A63B 2024/0093* (2013.01); *A63B 2069/165* (2013.01)

(58) Field of Classification Search
CPC ..... A63B 69/16–2069/168; A63B 23/0476; A63B 22/06–2022/0658; A63B 21/005–21/0052; A63B 21/0056; A63B 21/0057
See application file for complete search history.

(56) References Cited

U.S. PATENT DOCUMENTS 8,957,641 B1 * 2/2015 Hsu ..... A63B 21/0051 322/4
2001/0003110 A1 * 6/2001 Lay ..... A63B 21/0051 482/57

(Continued)

*Primary Examiner* — Jennifer M Deichl
(74) *Attorney, Agent, or Firm* — Muncy, Geissler, Olds & Lowe, P.C.

(57) ABSTRACT

An electromagnetically actuated bicycle trainer includes a base, a support assembly disposed on the base, and a hysteresis resistance generating module. The support assembly includes a support arm, and a fastening member disposed on the support arm and for securing an axle of a pedaling wheel. The hysteresis resistance generating module includes an inner magnetic stationary member and an outer magnetic stationary member, a semi-hard magnetic rotating member between the inner magnetic stationary member and the outer magnetic stationary member, and a conductive coil. The conductive coil receives an electric power and senses opposite magnetisms that the inner magnetic stationary member and the outer magnetic stationary member generate. Thus, the semi-hard magnetic rotating member is caused to generate a hysteresis resistance when rotated in response to hysteresis effects.

20 Claims, 8 Drawing Sheets

(51) Int. Cl.

| | |
|---|---|
| ***A63B 21/22*** | (2006.01) |
| ***A63B 22/06*** | (2006.01) |
| ***A63B 24/00*** | (2006.01) |
| ***A63B 69/16*** | (2006.01) |

(56) References Cited

U.S. PATENT DOCUMENTS

| | | | | |
|---|---|---|---|---|
| 2007/0021278 | A1* | 1/2007 | Pan | A63B 21/0051 482/63 |
| 2014/0171272 | A1* | 6/2014 | Hawkins, III | A63B 24/0087 482/61 |

* cited by examiner

ELECTROMAGNETICALLY ACTUATED BICYCLE TRAINER AND RESISTANCE CONTROL METHOD THEREOF

FIELD OF THE INVENTION

The present invention relates to a bicycle trainer, and particularly to an electromagnetically actuated bicycle trainer and a resistance control method thereof.

BACKGROUND OF THE INVENTION

Bicycles are a common transportation means. However, as times change, bicycles have also become a recreational means in the lives of modern people. Bicycle riding allows one to not only appreciate sceneries along the road while riding but also achieve the goal of working out for fitness, and is extensively loved by the public. However, not all occasions and climates (e.g., in the snow or rain) are suitable for bicycle riding. Thus, in order to enjoy the fun of bicycle riding under all circumstances, bicycle trainers have been developed. By securing and positioning one's bicycle on a bicycle trainer, one can stay amused with the fun of bicycle riding, disregarding space and location issues.

To better simulate actual riding conditions, a mechanical mechanism that changes the resistance along with speed is further disposed in certain bicycle trainers. The curve of the resistance may be set and adjusted according to a predetermined application scenario. However, such design only provides one single application scenario, and the amount of the resistance cannot be controlled as desired or be programmable.

Thus, a device with electrically controlled resistance is further designed. For example, the U.S. Patent Publication No. 20140171272, "Bicycle Trainer", includes a frame assembly and a flywheel assembly. The frame assembly is for supporting the flywheel assembly. The flywheel assembly includes a flywheel axle, T-shaped portions disposed annularly around the flywheel assembly, and a flywheel member connected to the flywheel axle. The T-shaped portions receive a current to generate a magnetic field. When the flywheel axle drives the flywheel member to rotate, the flywheel member rotates against the magnetic field and thus provides a braking force. The strength of the magnetic field can be varied by changing the current, and the amount of braking force can be changed to simulate different scenarios.

However, the above braking force consumes a substantial amount of electric power. Thus, current bicycle trainers can only achieve full operations and functions given that they are connected to an external power supply, meaning that current bicycle trainers are nonetheless bound by an application location restriction.

SUMMARY OF THE INVENTION

The primary object of the present invention is to solve an issue of a conventional trainer, which has a large power consumption and needs an external power supply that result in an application location restriction.

To achieve the above object, the present invention provides an electromagnetically actuated bicycle trainer. The electromagnetically actuated bicycle trainer includes a base, a support assembly disposed on the base, and a hysteresis resistance generating module mounted on the base. The support assembly includes a support arm disposed on the base, and a fastening member disposed at one end of the support arm away from the base and for securing an axle of a pedaling wheel. The hysteresis resistance generating module includes an inner magnetic stationary member, an outer magnetic stationary member, a semi-hard magnetic rotating member disposed between the inner magnetic stationary member and the outer magnetic stationary member, and a conductive coil receiving an electric power. The inner magnetic stationary member includes an accommodating groove for accommodating the conductive coil, and an inner magnetic sensing region. The external magnetic stationary member includes an outer magnetic sensing region. The semi-hard magnetic rotating member is correspondingly disposed between the inner magnetic sensing region and the outer magnetic sensing region, and rotates correspondingly to turning of a rear axle. The inner magnetic sensing region includes a plurality of inner recesses disposed at an interval to form a plurality of inner magnetic portions. The outer magnetic sensing region includes a plurality of outer recesses disposed at an interval to form a plurality of outer magnetic portions. The outer magnetic portions correspond to positions of the inner recesses, and the inner magnetic portions correspond to positions of the outer recesses.

The conductive coil receives the electric power and senses opposite magnetisms that the outer magnetic portions and the inner magnetic portions generate, such that the semi-hard magnetic rotating member correspondingly generates magnetism and generates a hysteresis resistance when rotated.

To achieve the above object, the present invention further provides a resistance control method of an electromagnetically actuated bicycle trainer. The control method includes following steps.

In step S1, a user adjusts strength of a predetermined pedaling resistance through a central control module.

In step S2, the central control module inputs an electric power to a conductive coil of a hysteresis resistance generating module. The conductive coil senses opposite magnetisms that a plurality of inner magnetic portions of an inner magnetic stationary member of the hysteresis resistance generating module and a plurality of outer magnetic portions of an outer magnetic stationary member of the hysteresis resistance generating module generate. The inner magnetic stationary member includes a plurality of inner recesses disposed at an interval from the inner magnetic portions. The outer magnetic stationary member includes a plurality of outer recesses disposed at an interval from the outer magnetic portions. The outer magnetic portions correspond to positions of the inner recesses, and the inner magnetic portions correspond to positions of the outer recesses.

In step S3, the user pedals and drives a pedaling wheel to turn, such that a semi-hard magnetic rotating member of the hysteresis resistance generating module rotates along with the pedaling wheel. The semi-hard magnetic rotating member is disposed between the inner magnetic stationary member and the outer magnetic stationary member.

In step S4, the semi-hard magnetic rotating member receives mutual effects of the outer magnetic portions and the inner magnetic portions to generate a hysteresis resistance that corresponds to the predetermined pedaling resistance of the user.

In conclusion, the present invention provides following features.

1. By using the hysteresis resistance generating module as a resistance generating mechanism, the hysteresis resistance of the inner magnetic stationary member and the outer magnetic stationary member is efficiently generated through the magnetic conductivity of the semi-hard magnetic rotating member. When the rear wheel drives the semi-hard magnetic rotating member to rotate, a smooth resistance can be generated to effectively and significantly reduce the required electric power.

2. As the semi-hard magnetic rotating member does not come into contact with the inner magnetic stationary member and the outer magnetic stationary member, issues of wear caused by friction is eliminated, thereby providing advantages of having a long lifecycle and reduced consumption costs.

3. A variable amount of resistance is achieved as the input voltage or current of the conductive coil is controllable, in a way that various riding scenarios can be more accurately simulated.

DETAILED DESCRIPTION OF THE PREFERRED EMBODIMENTS

Figure 1A:
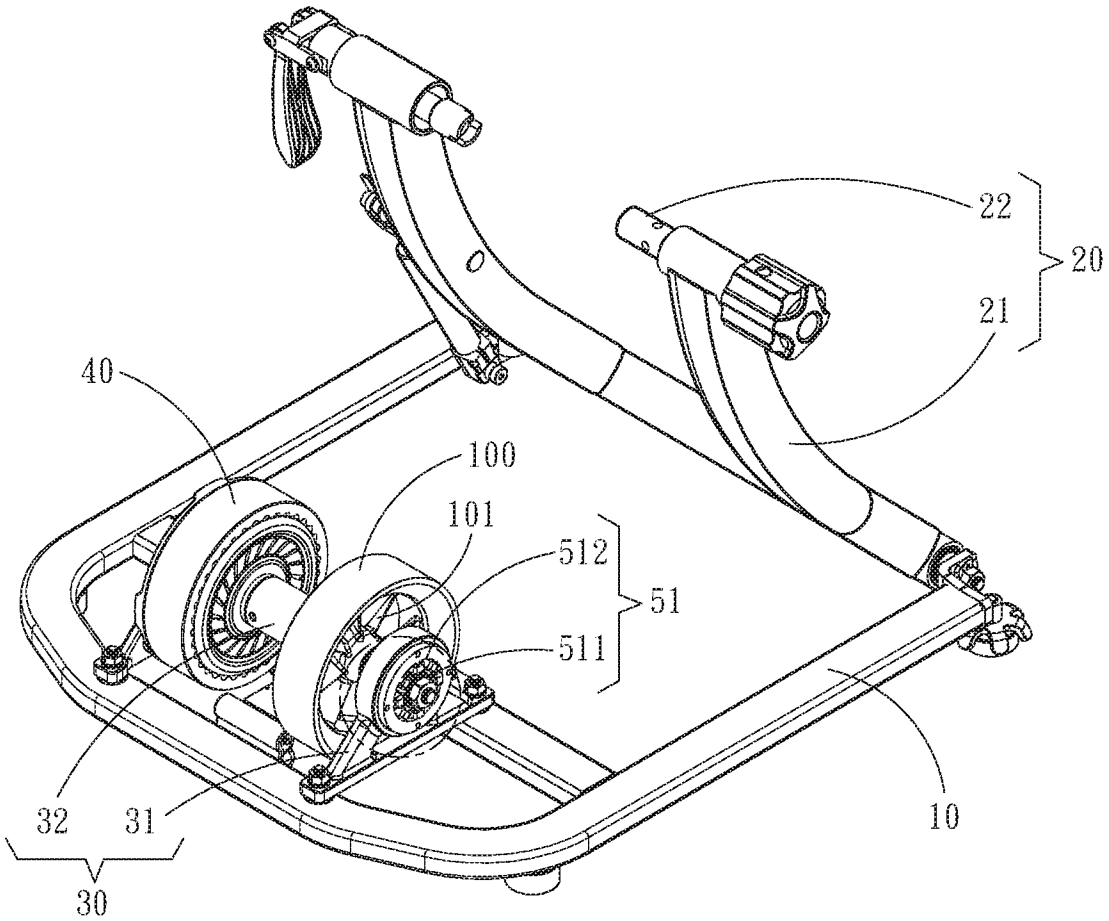
FIG. 1A shows a three-dimensional structural diagram according to a preferred embodiment of the present invention.

Referring to FIG. 1A, and FIG. 1B to FIG. 6, an electromagnetically actuated bicycle trainer includes a base 10, a support assembly 20 and a hysteresis resistance generating module 40. The support assembly 20 is disposed on the base 10, and includes a support arm 21 mounted on the base 10, and a fastening member 22 disposed at one end of the support arm 21 away from the base 10 and for fastening an axle (not shown) of a pedaling wheel 2. In the embodiment, two support arms 21 are given as an example.

Figure 2:
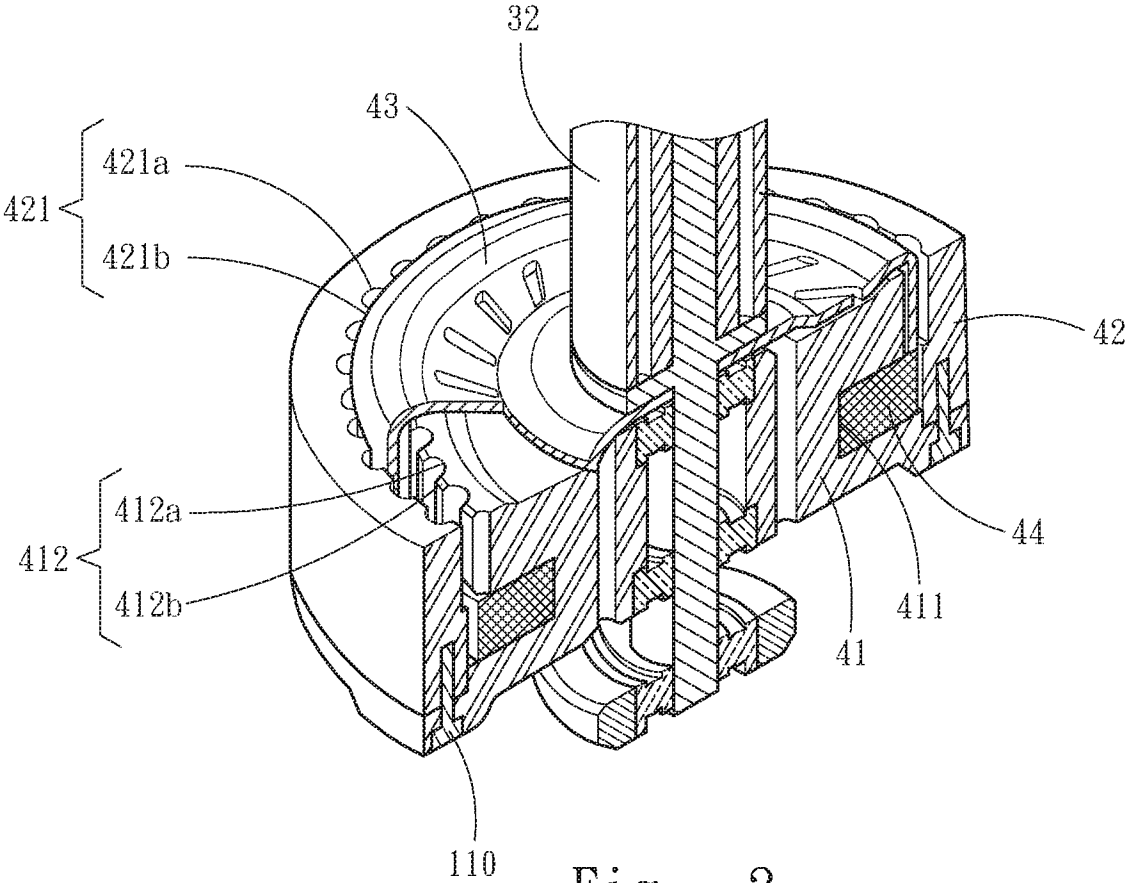
FIG. 2 is a three-dimensional section view of a hysteresis resistance generating module of the present invention.

Referring to FIG. 2, the hysteresis resistance generating module 40 includes an inner magnetic stationary member 41, an outer magnetic stationary member 42, a semi-hard magnetic rotating member 43, and a conductive coil 44 receiving an electric power. The inner magnetic stationary member 41 includes an accommodating groove 411 for accommodating the conductive coil 44, and an inner magnetic sensing region 412. The outer magnetic stationary member 42 includes an outer magnetic sensing region 421 corresponding to a position of the inner magnetic sensing region 412. In the embodiment, the inner magnetic stationary member 41 and the outer magnetic stationary member 42 are secured to each other by a securing member 110. The semi-hard magnetic rotating member 43 is disposed correspondingly between the inner magnetic sensing region 412 and the outer magnetic sensing region 421, and rotates correspondingly to the turning of the axle. Along a rotation direction of the semi-hard magnetic rotating member 43, the inner magnetic sensing region 412 includes a plurality of inner recesses 412*a* disposed at an interval to form a plurality of inner magnetic portions 412*b* adjacent to the semi-hard magnetic rotating member 43. Along a rotation direction of the semi-hard magnetic rotating member 43, the outer magnetic sensing region 421 includes a plurality of outer recesses 421*a* disposed at an interval to form a plurality of outer magnetic portions 421*b*. The outer magnetic portions 421*b* correspond to positions of the inner recesses 412*a*, and the inner magnetic portions 412*b* correspond to positions of the outer recesses 421*a*. The material of the semi-hard magnetic rotating member 43 may be selected from a group including iron, cobalt, nickel and an alloy of the above.

When the conductive coil receives 44 an electric power, it senses opposite magnetisms that the outer magnetic portions 421*b* and the inner magnetic portions 412*b* generate. Thus, the semi-hard magnetic rotating member 43 is caused to correspondingly generate magnetism and also generates a smooth resistance when it rotates, thereby effectively and significantly reducing the required electric power. Further, the inner magnetic stationary member 41, the outer magnetic stationary member 42 and the semi-hard magnetic rotating member 43 do not come into contact with one another, and so issues of replacement due to wear is eliminated to further increase the lifecycle and reduce consumption costs.

In the embodiment, the magnetically actuated bicycle trainer further includes a linkage assembly 30. The linkage assembly 30 includes a positioning seat 31 fixedly connected to the base 10, and a linkage axis 32 pivotally connected to the positioning seat 31. A distance between the linkage axis 32 and the fastening member 22 corresponds to a wheel diameter of the pedaling wheel 2, such that the linkage axis 32 comes into contact with the pedaling wheel 2 and rotates as the pedaling wheel 2 turns. Further, the semi-hard magnetic rotating member 43 is connected to the linkage axis 32 and rotates as the linkage axis 32 rotates.

Figure 1B:
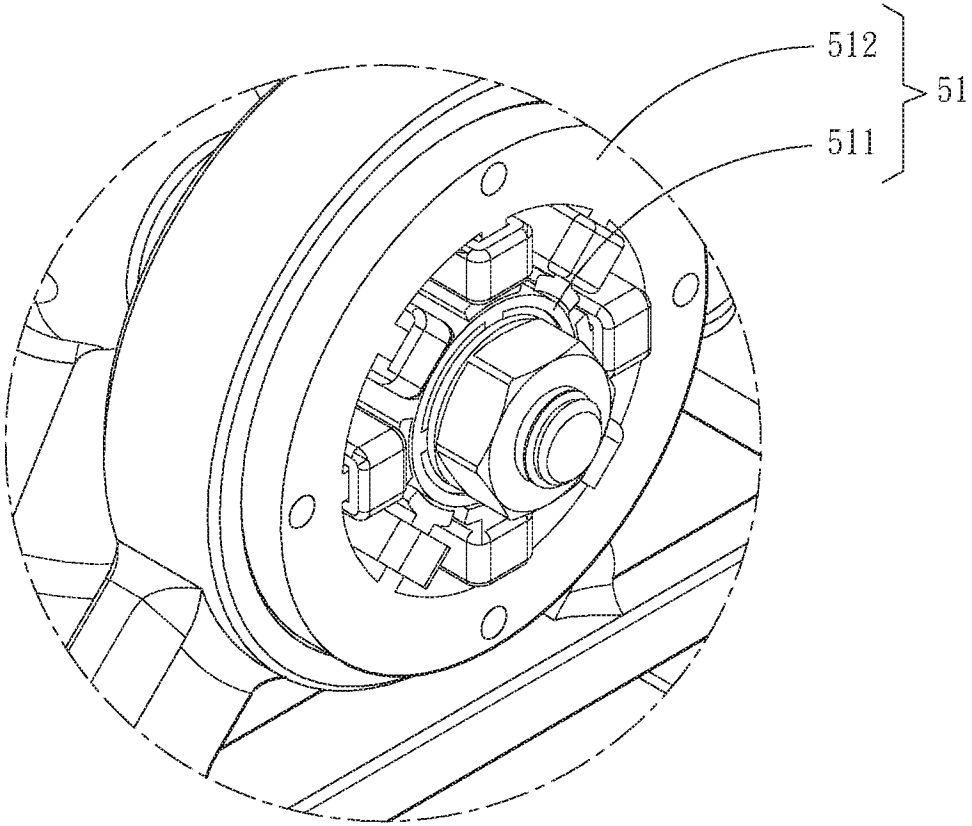
FIG. 1B is an enlarged partial view of FIG. 1A.

In the embodiment, the electric power is provided by a power generating and storage module 50 disposed on the base 10. The power generating and storage module 50 and the hysteresis resistance generating module 40 are disposed at two sides of the pedaling wheel 2, respectively. Thus, while the power generating and storage module 50 and the hysteresis resistance generating module 40 take effect simultaneously, not only the issue of mutual interference between the magnetic fields is prevented but also an effect of weight balance is achieved to ensure smooth rotations. The power generating and storage module 50 includes a power generator 51 that operates correspondingly to the pedaling wheel 2, a rectifying regulating unit 53 (shown in FIG. 5) electrically connected to the power generator 51, and a power storage unit 52 (shown in FIG. 5) electrically connected to the power generator 51. To better explain main structural parts of the magnetically actuated bicycle trainer, the rectifying regulating unit 53 and the power storage unit 52 are omitted in FIG. 1A and other structural diagrams. In the embodiment, the power generator 51 is connected to the linkage axis 32. As shown in FIG. 1B, the power generator 51 includes an inner rotor magnetic member 511 connected to the linkage axis 32, and a stator power generating assembly 512 surrounding the inner rotor magnetic member 511. When the linkage axis 32 drives the inner rotor magnetic member 511 located at the inner side to rotate, a smaller resistance can be used to change the magnetic field to cause the stator power generating assembly 512 to sense and to generate electric power. Meanwhile, a total force affecting the hysteresis resistance generating module 40 is reduced, such that the resistance value that the hysteresis resistance generating module 40 provides is more accurate.

The rectifying regulating unit 53 rectifies and regulates the electric power that the power generator 51 generates, and transmits the rectified and regulated electric power to the power storage unit 52. The power storage unit 52 stores the electric power, and provides the electric power to the hysteresis resistance generating module 40 when needed to allow the outer magnetic portions 421*b* and the inner magnetic portions 412*b* to generate opposite magnetisms. Thus, the power generated from the user's pedaling the pedaling wheel 2 is converted to the electric power and stored to achieve an object of self sustainability. Without connecting to an external power supply, the magnetically actuated bicycle trainer can be applied in various occasions where electric power is unavailable, such as the suburbs and scenic spots, hence staying free from environmental restrictions as well as satisfying the go-green trend. In the embodiment, for example but not limited to, the power storage unit 52 is a lithium battery.

Further, while the semi-hard magnetic rotating member 43 rotates, in response to the magnetisms of the inner magnetic stationary member 41 and the outer magnetic stationary member 42, the arrangement of particles of the semi-hard magnetic rotating member 43 is constantly changed and the magnetic pole is hence changed, heat energy is generated. Further, heat energy is also generated during the power generation process of the power generator 51. Thus, a heat dissipating member 100 may be disposed on the linkage axis 32 to dissipate heat of the hysteresis resistance generating module 40 and the power generator 51, so as to reduce the effects generated by the heat, e.g., reduced efficiency. In the embodiment, for example but not limited to, the heat dissipating member 100 is disposed between the hysteresis resistance generating module 40 and the power generator 51, and includes a plurality of blades 101 connected to the linkage axis 32 and regarding the linkage axis 32 as a center.

Figure 3:
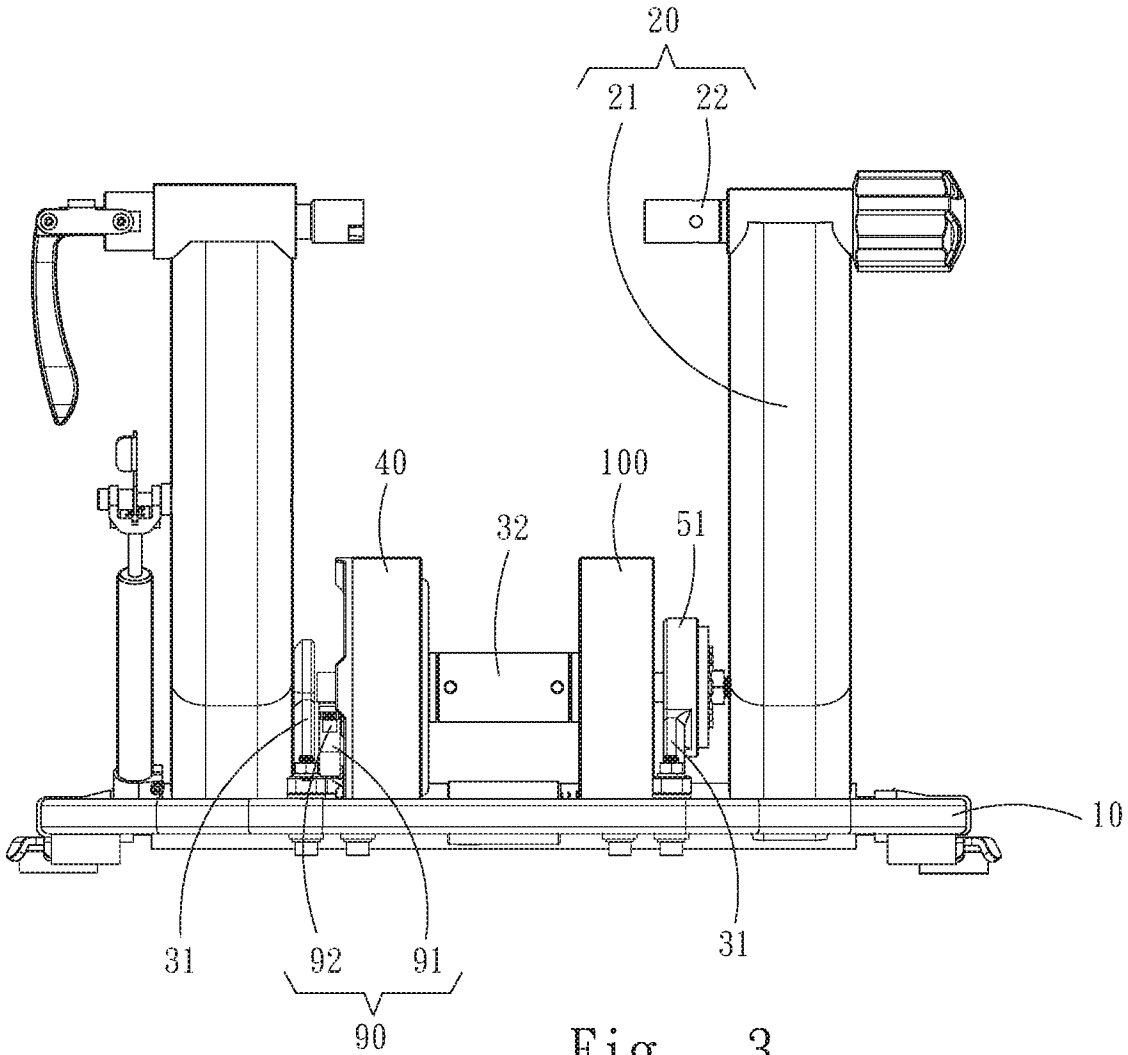
FIG. 3 is a two-dimensional rear view according to a preferred embodiment of the present invention.
Figure 4:
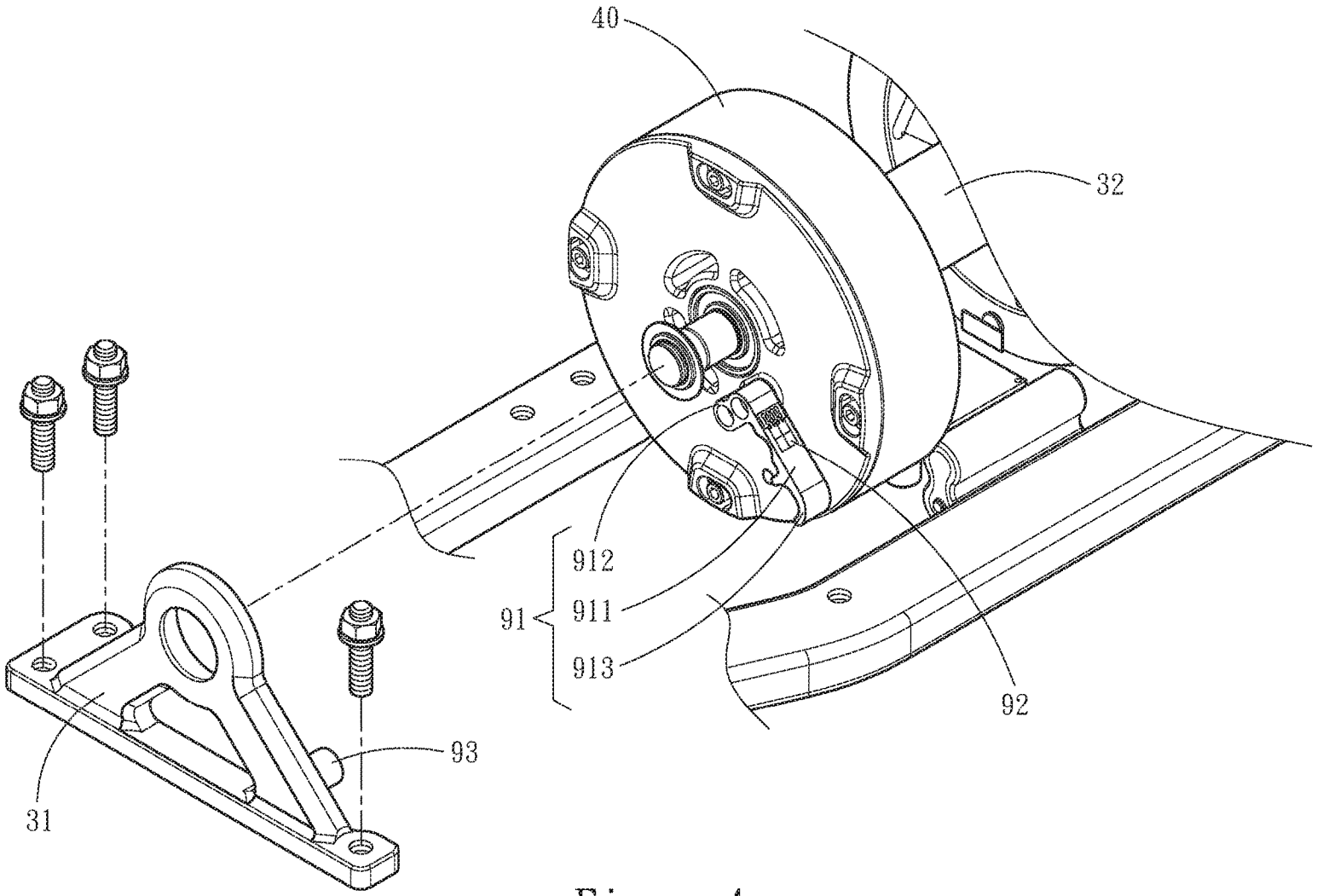
FIG. 4 is an exploded partial view according to a preferred embodiment of the present invention.

As shown in FIG. 3 and FIG. 4, the present invention further includes a force detecting module 90. The force detecting module 90 includes a connecting stationary arm 91 fixedly connected to the hysteresis resistance generating module 40, a deformation sensing unit 92 disposed on the connecting stationary arm 91, and a blocking member 93 secured on the base 10. In the embodiment, the blocking member 93 is disposed on the positioning seat 31. The connecting stationary arm 91 includes a main body 911 for disposing the deformation sensing unit 92, and a connecting end 912 and a force receiving end 913 respectively located at two ends of the main body 911. The connecting end 912 is fixedly connected to the outer magnetic stationary member 42 of the hysteresis resistance generating module 40. The force receiving end 913 corresponds to a position of the blocking member 93. When the pedaling wheel 2 drives the linkage axis 32 to turn, the hysteresis resistance generating module 40 and the connecting stationary arm 91 are also driven. However, when being driven, the force receiving end 913 of the connecting stationary arm 91 is blocked by the blocking member 93, such that deformation of the connecting stationary arm 91 is produced. Thus, the deformation sensing unit 92 disposed on the main body 911 senses the amount of deformation and calculates a pedaling power of the rider. Compared to a conventional method of simulating the strength of force using computerized simulations based on acceleration, the above approach of the present invention not only is more accurate but also further allows calculation for burned calories of the rider for fitness evaluations in collaboration with other information.

Figure 5:
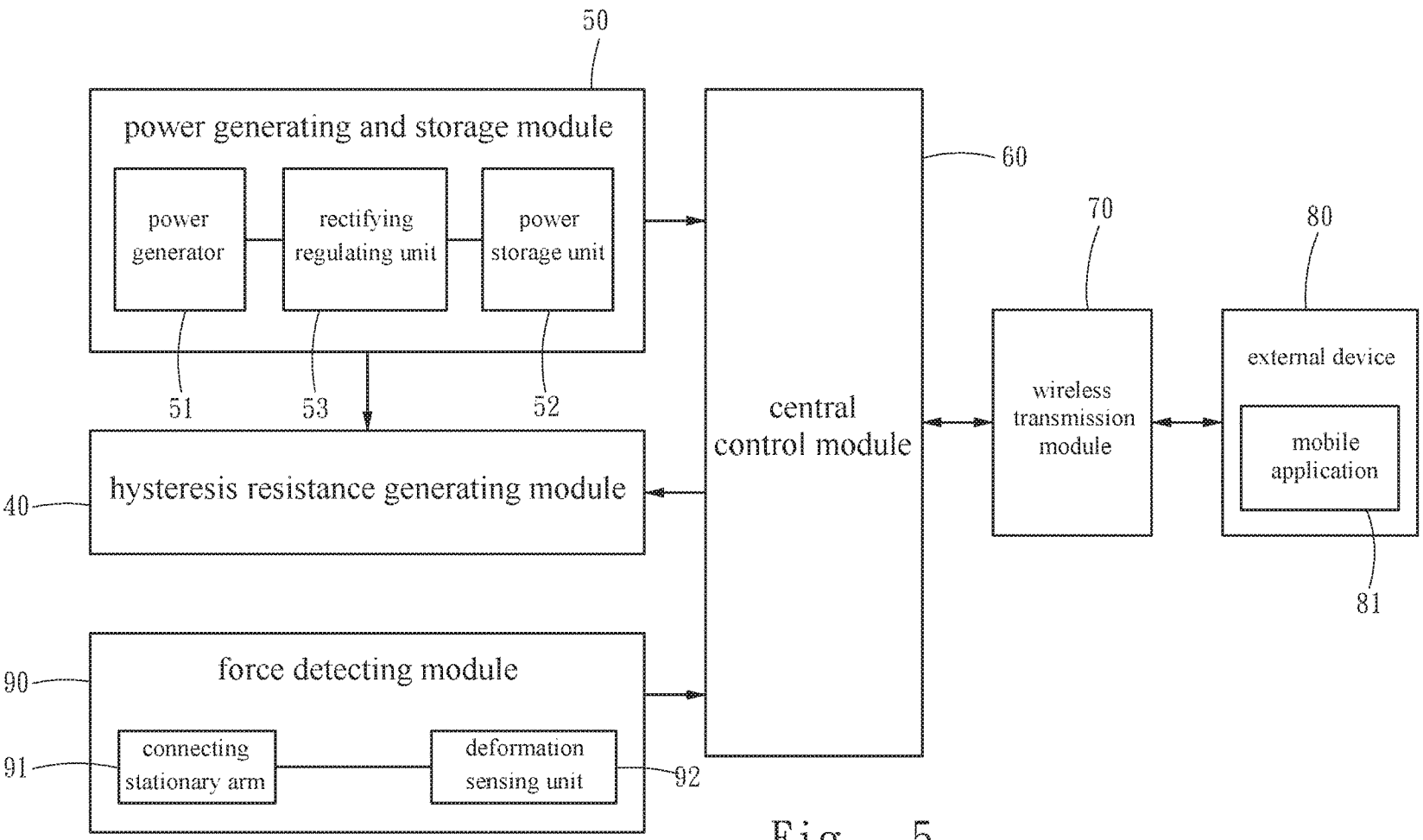
FIG. 5 is a functional block diagram according to a preferred embodiment of the present invention.

Referring to FIG. 5, the embodiment further includes central control module 60, a wireless transmission module 70 and an external device 80. The central control module 60, electrically connected to the hysteresis resistance generating module 40, the power generating and storage module 50 and the force detecting module 90, detects and calculates various types of riding data, e.g., pedaling power, riding speed, pedaling frequency, riding time, distance and burned calories, and is further capable of adjusting the input power of the hysteresis resistance generating module 40. The central control module 60 is further electrically connected the wireless transmission module 70. The wireless transmission module 70, through a wireless transmission means, e.g., Bluetooth Smart or ANT+, outputs the riding data to the external device 80. For example, the external device 80 may be a cell phone, a tablet computer, a computer or a television, to display the riding data. Moreover, the external device 80 may further include a mobile application 81 that serves as an active programmable interface for the user to perform settings such as adjusting the pedaling resistance. Details of an actual operation process is to be described shortly, and shall be omitted in this paragraph.

Figure 6:
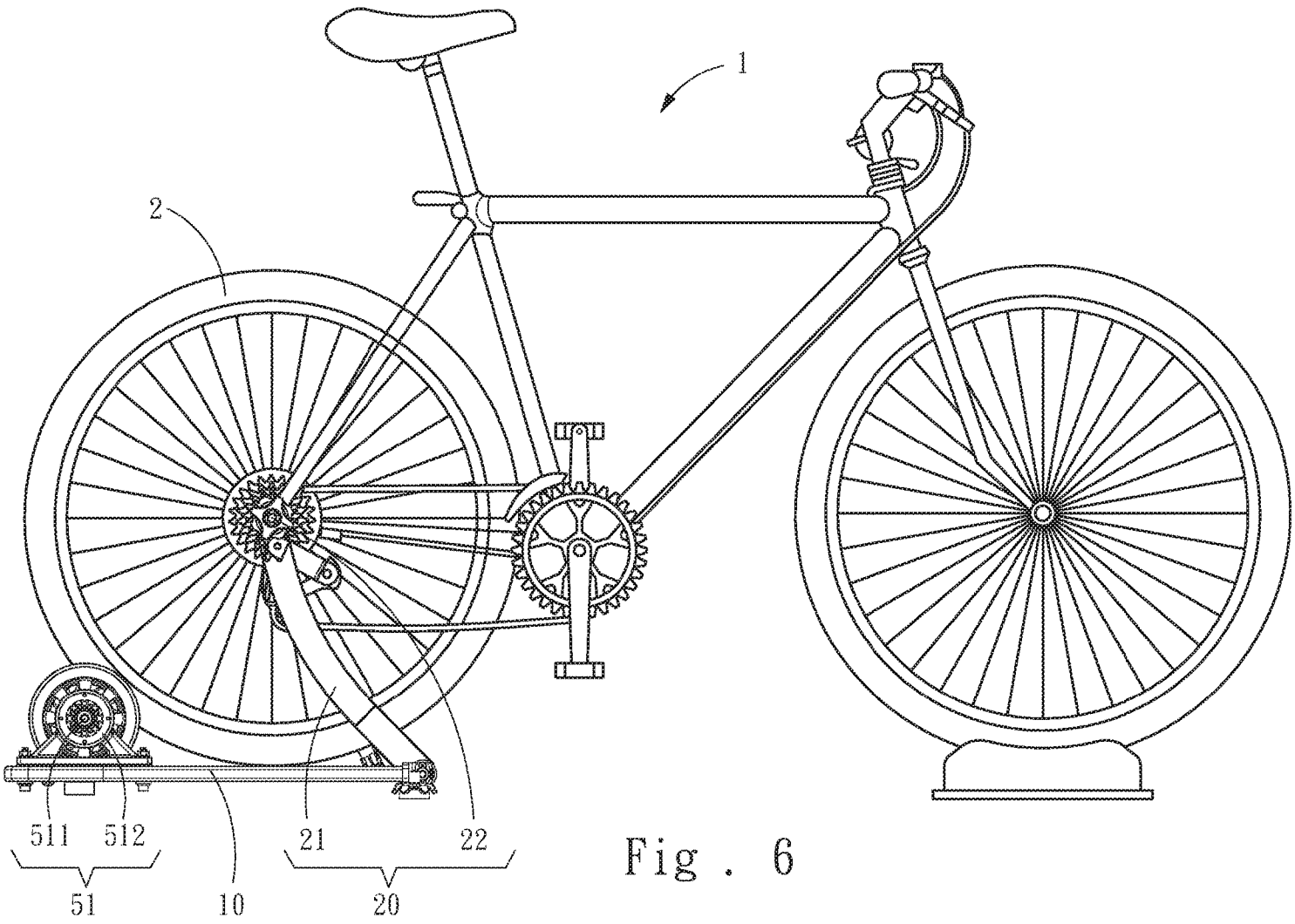
FIG. 6 is a schematic diagram of an application status according to a preferred embodiment of the present invention.

FIG. 6 shows an application status of a preferred embodiment. A rear axle of common bicycle 1 is directly applied with the present invention. More specifically, to apply the present invention, the two fastening members 22 are clamped at two sides of the rear axle, respectively, to secure the rear axle. The distance between the linkage axis 32 and the fastening members 22 is adjusted to correspond to the wheel diameter of the pedaling wheel 2, such that the linkage axis 32 comes into contact with the pedaling wheel 2 and rotates as the pedaling wheel 2 turns. The rotation of the linkage axis 32 synchronously drives the power generator 51 and the hysteresis resistance generating module 40. The inner rotor magnetic member 511 of the power generator 51 rotates to cause the stator power generating assembly 512 to sense and generate the electric power, which is provided to the hysteresis resistance generating module 40 through the power storage unit 52 to generate resistance. In addition to the above method of assembling to a common bicycle, the present invention may also be applied to a flywheel pedaling mechanism that is a formed integral. Similarly, the strength of resistance is adjusted through the hysteresis resistance generating module 40, and self-sustainable electric power can be provided through the power generating and storage module 50.

Figure 7:
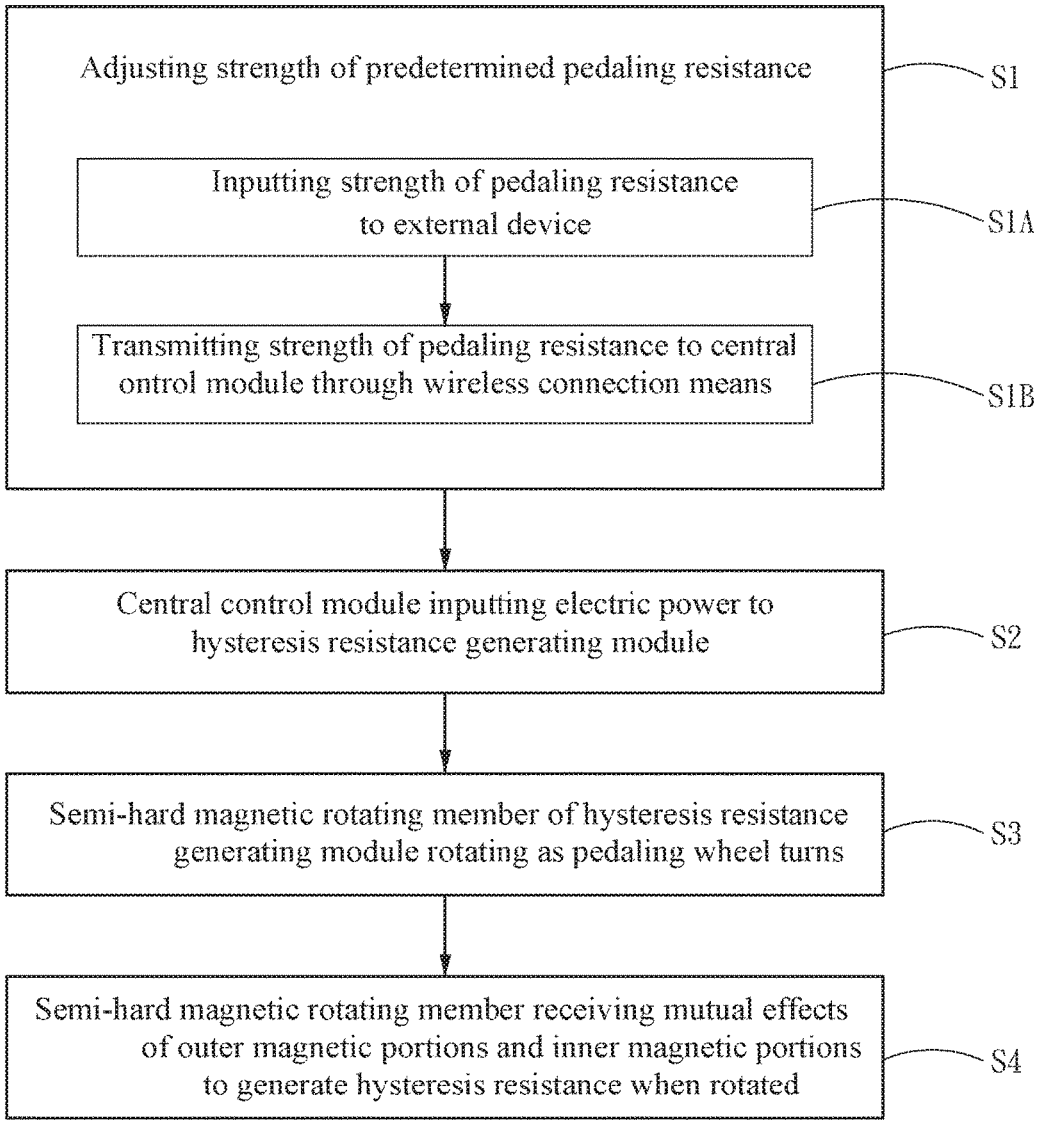
FIG. 7 is a flowchart according to a preferred embodiment of the present invention.

Referring to FIG. 7, the resistance control method of the present invention includes following steps.

In step S1, a user adjusts the strength of a predetermined pedaling resistance through a central control module 60. Alternatively, the user selects a simulated path through a simulated path selecting module to allow the central control module 60 to adjust the strength of the pedaling resistance according to a virtual route. Thus, the resistance of an actual riding path can be simulated to enhance riding pleasure. Step S1 further includes following steps.

In step S1A, the user inputs the strength of the pedaling resistance to a mobile application 81 in an external device 80.

In step S1B, the mobile application 81, through a wireless connection means, e.g., Bluetooth Smart or ANT+, transmits the strength of the pedaling resistance to a wireless transmission module 70 and further to the central control module 60.

In step S2, the central control module 60 inputs an electric power to a conductive coil 44 of a hysteresis resistance generating module 40 according to the strength of the pedaling resistance. The conductive coil 44 senses opposite magnetisms that a plurality of inner magnetic portions 412*b* of an inner magnetic stationary member 41 of the hysteresis resistance generating module 40 and a plurality of outer magnetic portions 421*b* of an outer magnetic stationary member 42 of the hysteresis resistance generating module 40 generate. The inner magnetic stationary member 41 includes a plurality of inner recesses 412*a* disposed at an interval from the inner magnetic portions 412*b*. The outer magnetic stationary member 42 includes a plurality of outer recesses 421*a* disposed at an interval from the outer magnetic portions 421*b*. Further, the outer magnetic portions 421*b* correspond to positions of the inner recesses 412*a*, and the inner magnetic portions 412*b* correspond to positions of the outer recesses 421*a*.

In step S3, the user pedals and drives a pedaling wheel 2 to turn, and causes a semi-hard magnetic rotating member 43 of the hysteresis resistance generating module 40 to rotate along with the pedaling wheel 2. The semi-hard magnetic rotating member 43 is disposed between the inner magnetic stationary member 41 and the outer magnetic stationary member 42. Meanwhile, the pedaling wheel 2 jointly drives a power generating and storage module 50 for power generation and storage. The electric power stored by the power generating and storage module 50 is provided for use in step S2. Heat energy is generated while the hysteresis resistance generating module 40 generates resistance and the power generating and storage module 50 generates power. Thus, the pedaling wheel 2 may jointly drive a heat dissipating member 100 that dissipates heat of the hysteresis resistance generating module 40 and the power generating and storage module 50.

In step S4, as opposite magnetisms are generated by the outer magnetic portions 421*b* and the inner magnetic portions 412*b*, the semi-hard magnetic rotating member 43 receives the mutual effects of the opposite magnetisms and generates a hysteresis resistance when rotated. The hysteresis resistance corresponds to the predetermined pedaling resistance of the user.

In conclusion, the present invention provides following features.

1. By using the hysteresis resistance generating module as a resistance generating mechanism, the hysteresis resistance of the inner magnetic stationary member and the outer magnetic stationary member is efficiently generated through the magnetic conductivity of the semi-hard magnetic rotating member. When the rear wheel drives the semi-hard magnetic rotating member to rotate, a smooth resistance can be generated to effectively and significantly reduce the required electric power.

2. As the semi-hard magnetic rotating member, the inner magnetic stationary member and the outer magnetic stationary member do not come into contact with one another, issues of wear caused by friction is eliminated, thereby providing advantages of having a long lifecycle and reduced consumption costs.

3. By using the inner rotor magnetic member as the power generator, an advantage of having a small resistance is provided, leaving the total resistance generated by the hysteresis resistance generating module unaffected.

4. The electric power generated by the power generating and storage module is provided to the hysteresis resistance generating module. With the low power consumption property of the hysteresis resistance generating module, no additional power line connected to a socket is required, thereby allowing the present invention to be totally unbound by any environmental, time and space restrictions.

5. With the collaboration of the central control module, the current or voltage of the conductive coil can be controlled as desired to further simulate conditions of various application scenarios, or to even replicate resistance values collected in real riding routes on the bicycle trainer.

6. Heat dissipation of the hysteresis resistance generating module and the power generator is performed by the heat dissipating member, hence reducing the effects generated by heat.

7. The force detecting module is capable of detecting the actual pedaling strength of the user, and provides a more accurate result comparing to a conventional method that calculates the strength though computerized simulations based on acceleration.

8. By electrically connecting the central control module to the hysteresis resistance generating module, the power generating and storage module, and the force detecting module, various types of riding data can be detected, and then transmitted to the external device by the wireless transmission module for the user to observe. Further, a programmable interface can be formed in conjunction with software for the user to perform adjustment and setting.

What is claimed is:

1. An electromagnetically actuated bicycle trainer, comprising:

a base;

a support assembly, disposed on the base, comprising a support arm mounted on the base and a fastening member disposed at one end of the support arm away from the base and for fastening an axle of a pedaling wheel; and a hysteresis resistance generating module, comprising an inner magnetic stationary member, an outer magnetic stationary member, a semi-hard magnetic rotating member disposed between the inner magnetic stationary member and the outer magnetic stationary member, and a conductive coil that receives an electric power; the inner magnetic stationary member comprising an accommodating groove for accommodating the conductive coil, and an inner magnetic sensing region; the outer magnetic stationary member comprising an outer magnetic sensing region; the semi-hard magnetic rotating member correspondingly disposed between the inner magnetic sensing region and the outer magnetic sensing region, and rotating correspondingly to turning of the axle; the inner magnetic sensing region comprising a plurality of inner recesses disposed at an interval to form a plurality of inner magnetic portions; the outer magnetic sensing region comprising a plurality of outer recesses disposed at an interval to form a plurality of outer magnetic portions; the outer magnetic portions corresponding to positions of the inner recesses, and the inner magnetic portions corresponding to positions of the outer recesses;

wherein, the conductive coil receives the electric power to sense opposite magnetisms that the outer magnetic portions and the inner magnetic portions generate, such that semi-hard magnetic rotating member correspondingly generates magnetism and generates a hysteresis resistance when rotated.

2. The electromagnetically actuated bicycle trainer of claim 1, wherein the outer magnetic sensing region corresponds to a position of the inner magnetic sensing region, the inner magnetic portions and the outer recesses dispose adjacent to the semi-hard magnetic rotating member, and the outer magnetic portions and the inner recesses dispose adjacent to the semi-hard magnetic rotating member.

3. The electromagnetically actuated bicycle trainer of claim 1, further comprising:

a linkage assembly, disposed opposite the support assembly and on the base, comprising a positioning seat fixedly connected on the base and a linkage axis pivotally connected to the positioning seat, a distance between the linkage axis and the fastening member corresponding to a wheel diameter of the pedaling wheel, such that the linkage axis comes into contact with the pedaling wheel and rotates as the pedaling wheel turns;

wherein, the semi-hard magnetic rotating member is connected to the linkage axis, and rotates as the linkage axis rotates.

4. The electromagnetically actuated bicycle trainer of claim 1, further comprising:

a power generating and storage module, disposed on the base, comprising a power generator operating correspondingly to turning of the pedaling wheel, a rectifying regulating unit electrically connected to the power generator, and a power storage unit electrically connected to the rectifying regulating unit, the power storage unit providing the electric power to the hysteresis resistance generating module.

5. The electromagnetically actuated bicycle trainer of claim 4, further comprising:

a central control module, electrically connected to the hysteresis resistance generating module and the power generating and storage module.

6. The electromagnetically actuated bicycle trainer of claim 5, further comprising:

a wireless transmission module, electrically connected to the central control module; and an external device, wirelessly connected to the wireless transmission module.

7. The electromagnetically actuated bicycle trainer of claim 6, wherein the external device comprises a mobile application for controlling the central control module.

8. The electromagnetically actuated bicycle trainer of claim 4, wherein the power generator further comprises an inner rotor magnetic member rotating correspondingly to the turning of the pedaling wheel, and a stator power generating assembly surrounding the inner rotor magnetic member; magnetic fields are changed through turning of the inner rotor magnetic member to cause the stator power generating assembly to sense and generate the electric power.

9. The electromagnetically actuated bicycle trainer of claim 3, further comprising:

a power generating and storage module, disposed on the base, comprising a power generator connected to the linkage axis, a rectifying regulating unit electrically connected to the power generator, and a power storage unit electrically connected to the rectifying regulating unit, the power storage unit providing the electric power to the hysteresis resistance generating module.

10. The electromagnetically actuated bicycle trainer of claim 9, wherein the hysteresis resistance generating module and the power generating and storage module are disposed at two sides of the pedaling wheel, respectively.

11. The electromagnetically actuated bicycle trainer of claim 10, further comprising:

a heat dissipating member, disposed on the linkage axis, and between the hysteresis resistance generating module and the power generating and storage module, comprising a plurality of blades connected to the linkage axis and regarding the linkage axis a center.

12. The electromagnetically actuated bicycle trainer of claim 3, further comprising:

a heat dissipating member, disposed on the linkage axis, comprising a plurality of blades connected to the linkage axis and regarding the linkage axis a center.

13. The electromagnetically actuated bicycle trainer of claim 1, further comprising:

a force detecting module, comprising a connecting stationary arm connected to the hysteresis resistance generating module, a deformation sensing unit disposed on the connecting stationary arm, and a blocking member secured on the base; the connecting stationary arm comprising a main body for disposing the deformation sensing unit, and a connecting end and a force receiving end located at two ends of the main body, respectively, the connecting end fixedly connected to the outer magnetic stationary member of the hysteresis resistance generating module, the force receiving end corresponding to a position of the blocking member.

14. The electromagnetically actuated bicycle trainer of claim 13, further comprising:

a central control module, electrically connected to the force detecting module;

a wireless transmission module, electrically connected to the central control module; and an external device, wirelessly connected to the wireless transmission module.

15. A control method of an electromagnetically actuated bicycle trainer, comprising steps of:

S1: a user adjusting strength of a predetermined resistance through a central control module;

S2: the central control module inputting an electric power to a conductive coil of a hysteresis resistance generating module, the conductive coil sensing opposite magnetisms that a plurality of inner magnetic portions of an inner magnetic stationary member of the hysteresis resistance generating module and a plurality of outer magnetic portions of an outer magnetic stationary member of the hysteresis resistance generating module generate; the inner magnetic stationary member comprising a plurality of inner recesses disposed at an interval from the inner magnetic portions, the outer magnetic stationary member comprising a plurality of outer recesses disposed at an interval from the outer magnetic portions; the outer magnetic portions corresponding to positions of the inner recesses, and the inner magnetic portions corresponding to positions of the outer recesses;

S3: the user pedaling and driving a pedaling wheel rotate, and causing a semi-hard magnetic rotating member of the hysteresis resistance generating module to rotate along with the pedaling wheel, the semi-hard magnetic rotating member being disposed between the inner magnetic stationary member and the outer magnetic stationary member; and S4: the semi-hard magnetic rotating member receiving mutual effects of the outer magnetic portions and the inner magnetic portions, and generating a hysteresis resistance when rotated, the hysteresis resistance corresponding to the predetermined pedaling resistance of the user.

16. The control method of an electromagnetically actuated bicycle trainer of claim 15, wherein step S1 further comprises steps of:

S1A: the user inputting the strength of the pedaling resistance to a mobile application in an external device; and S1B: the mobile application transmitting the strength of the pedaling resistance to a wireless transmission module and further to the central control module.

17. The control method of an electromagnetically actuated bicycle trainer of claim 16, wherein in step S1B, a wireless connection means is selected from a group including Bluetooth Smart and ANT+.

18. The control method of an electromagnetically actuated bicycle trainer of claim 15, wherein in step S3, the pedaling wheel jointly drives a power generating and storage module for power generation and storage; the electric power stored by the power generating and storage module is provided for use in step S2.

19. The control method of an electromagnetically actuated bicycle trainer of claim 15, wherein in step S3, the pedaling wheel jointly drives a heat dissipating member that dissipates heat of the hysteresis resistance generating module and the power generating and storage module.

20. The control method of an electromagnetically actuated bicycle trainer of claim 15, wherein in step S1, the user selects a simulated path through a simulated path selecting module, and allows the central control module to adjust the strength of the pedaling resistance according to a virtual route.

* * * * *